United States Patent [19]

Tachiki et al.

[11] Patent Number: 4,565,758

[45] Date of Patent: Jan. 21, 1986

[54] ELECTROPHOTOGRAPHIC PLATE HAVING A CHARGE GENERATING LAYER CONTAINING AN ORGANIC PIGMENT FOR CHARGE GENERATION

[75] Inventors: Shigeo Tachiki; Ikutoshi Shibuya, both of Hitachi; Makoto Fujikura, Matsudo; Atsushi Kakuta, Hitachiota, all of Japan

[73] Assignees: Hitachi, Ltd.; Hitachi Chemical Company Ltd., both of Tokyo, Japan

[21] Appl. No.: 627,890

[22] Filed: Jul. 5, 1984

Related U.S. Application Data

[63] Continuation of Ser. No. 420,888, Sep. 21, 1982, abandoned.

[30] Foreign Application Priority Data

Sep. 22, 1981 [JP] Japan ..... 56-150095
May 14, 1982 [JP] Japan ..... 57-82235

[51] Int. Cl.[4] ..... G03G 5/10

[52] U.S. Cl. ..... 430/58; 430/66; 430/83

[58] Field of Search ..... 430/58, 59, 66, 83

[56] References Cited

U.S. PATENT DOCUMENTS 4,148,637 10/1979 Kubota et al. ..... 430/66
4,203,764 5/1980 Tosaka et al. ..... 430/67
4,250,240 2/1981 Shimada et al. ..... 430/66

*Primary Examiner*—John L. Goodrow
*Attorney, Agent, or Firm*—Antonelli, Terry & Wands

[57] ABSTRACT

An electrophotographic plate comprising an electroconductive layer, a charge generating layer and a charge transport layer and containing a silane coupling agent at least in the charge generating layer or in the charge transport layer, or at the interface of the charge generating layer and the charge transport layer shows small dark decay, little light fatigue and high sensitivity.

18 Claims, No Drawings

ELECTROPHOTOGRAPHIC PLATE HAVING A CHARGE GENERATING LAYER CONTAINING AN ORGANIC PIGMENT FOR CHARGE GENERATION

This is a continuation of application Ser. No. 420,888, filed Sept. 21, 1982 now abandoned.

This invention relates to an electrophotographic plate having a charge generating layer and a charge transport layer with small dark decay and little light fatigue.

Heretofore, as electrophotographic materials applying photoconductive substances as light sensitive materials, there have mainly been used inorganic photoconductive substances such as selenium, zinc oxide, titanium oxide, cadmium sulfide, etc. But most of these substances are generally highly toxic and there is a problem in dumping them.

On the other hand, organic photoconductive compounds have recently widely been studied, since they generally have weak toxicity compared with the inorganic photoconductive substances and are advantageous in transparency, flexibility, light-weight, surface smoothness, price, etc. Under such circumstances, complex type electrophotographic plates, which separate functions of charge generation and charge transport, have recently developed rapidly, since they can greatly improve sensitivity which has been a great defect of electrophotographic plates using organic photoconductive compounds.

But when these complex type electrophotographic plates ae used, for example, in an electrophotographic copying device according to the Carlson process, the initial potential is lowered by repeated use and the dark decay increases, which results in causing blushing in copied images obtained and often remarkably damaging contrast of the images. Further, when these complex type electrophotographic plates are used in an electrophotographic copying device wherein a plurality of copied images are obtained by repeating development and transfer without damaging an electrostatic latent image formed by one exposure to light, the copied image density is gradually lowered due to large dark decay.

As mentioned above, although the complex type electrophotographic plates have high sensitivity, they also have defects in that the dark decay is large and there appears a phenomenon of light fatigue wherein the initial potential is lowered and at the same time the dark decay increases when exposed to light for a long period of time. Particularly when the charge generating layer is thick, a lowering of properties due to light fatigue is remarkable.

An object of this invention is to solve the problems mentioned heretofore and to provide a complex type electrophotographic plate characterized in that (1) the dark decay is small, (2) lowering of the charge potential is small and the dark decay is not increased even if repeating charge/exposure (that is, light fatigue is little), and (3) high sensitivity is shown.

In accordance with this invention, there is provided an electrophotographic plate comprising an electroconductive layer, a charge generating layer containing one or more organic pigments for charge generation and a charge transport layer having functions of charge maintenance and charge transport, characterized in that a silane coupling agent is present at least in the charge generating layer or in the charge transport layer, or at the interface of these two layers.

Materials used in the electrophotographic plate of this invention are explained below.

As the silane coupling agent which is present at least in the charge generating layer or in the charge transport layer, or at the interface of these layers, there can be used vinylsilanes such as vinyltrichlorosilane, vinyltriethoxysilane, vinyltris(β-methoxyethoxy)silane, γ-methacryloxypropyltrimethoxysilane, etc., epoxysilanes such as γ-glycidoxypropyltrimethoxysilane, etc., aminosilanes such as N-β-(aminoethyl)-γ-aminopropyltrimethoxysilane, γ-aminopropyltriethoxysilane, N-β-(aminoethyl)-γ-aminopropylmethyldimethoxysilane, N-β-(N-vinylbenzylaminoethyl)-γ-aminopropyltrimethoxysilane, etc., and their hydrochlorides, mercaptosilanes such as γ-mercaptopropyltrimethoxysilane, etc., alone or as a mixture thereof. Among them, the aminosilanes are particularly effective for improving the dark decay and the light fatigue.

When the silane coupling agent is included in the charge generating layer (CGL), it is included preferably in an amount of 0.5 to 40% by weight, more preferably 1 to 20% by weight, based on the weight of the charge generating layer. When the amount is less than 0.5% by weight, there is a tendency to exhibit less effects for reducing the dark decay and lessening the light fatigue, while if the amount is more than 40% by weight, although there show good effects on improving the initial potential, dark decay and light fatigue, there is a tendency to lower the sensitivity.

When the silane coupling agent is included in the charge transport layer (CTL), it is included preferably in an amount of 0.05 to 30% by weight, more preferably 0.1 to 10% by weight, based on the weight of the charge transport layer. When the amount is less than 0.05% by weight, there shows less effect for reducing the dark decay and lessening the light fatigue, while if the amount is more than 30% by weight, although there show good effects on improving the initial potential, dark decay and light fatigue, there is a tendency to lower the sensitivity and to increase residual potential.

When the silane coupling agent is present at the interface of the charge generating layer and the charge transport layer, it is used in terms of an amount in a unit area of preferably $10^{-4}$ mg/cm$^2$ to $10^2$ mg/cm$^2$, more preferably $10^{-3}$ mg/cm$^2$ to 10 mg/cm$^2$. When the amount is less than $10^{-4}$ mg/cm$^2$, there is less effect for improving the light fatigue and the dark decay, while if the amount is more than $10^2$ mg/cm$^2$, there is a tendency to lower the sensitivity and to increase the residual potential.

The silane coupling agent can be present both in the CGL and CTL, in the CGL or CTL and at the interface of CGL and CTL, or both in the CGL and CTL and at the interface of CGL and CTL at the same time.

As the organic pigment which is included in the charge generating layer for charge generation, there can be used azoxybenzenes, disazos, trisazos, benzimidazoles, multi-ring quinones, indigoids, quinacridones, metallic or non-metallic phthalocyanines having various crystal structures, perylenes, methines, etc., these pigments being known for charge generation. These pigments can be used alone or as a mixture thereof. These pigments are, for example, disclosed in British Patent Nos. 1,370,197, 1,337,222, 1,337,224 and 1,402,967, U.S. Pat. Nos. 3,887,366, 3,898,084, 3,824,099 and 4,028,102, Canadian Patent No. 1,007,095, German Offenlegungsschrift No. 2,260,540, etc. It is also possible to use all organic pigments which can generate charge carriers by illumination with light other than those mentioned above.

A part of typical examples of the organic pigments are illustrated below, but needless to say, the organic pigments are not limited thereto.

Examples of the phthalocyanine series pigments are copper phthalocyanine, metal free phthalocyanine, magnesium phthalocyanine, aluminum phthalocyanine, copper chromium phthalocyanine, copper-sulfated phthalocyanine, etc. As to their crystal forms, $\alpha$-form, $\beta$-form, $\gamma$-form, $\epsilon$-form, $\chi$-form, etc., may be used.

Examples of the disazo series pigments are as follows:

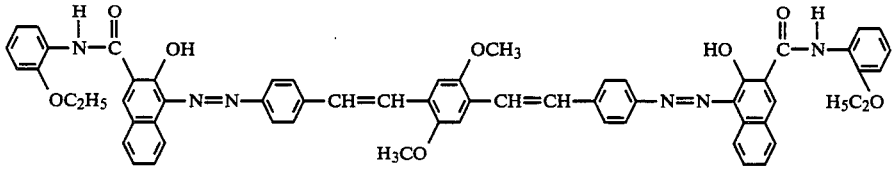

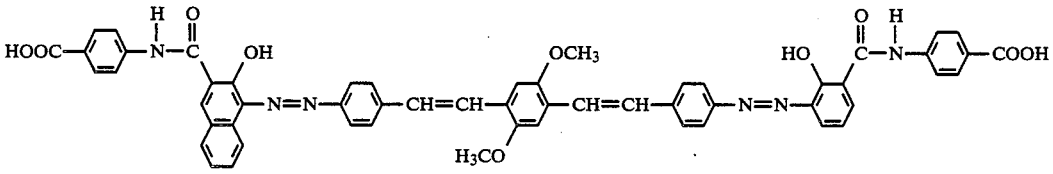

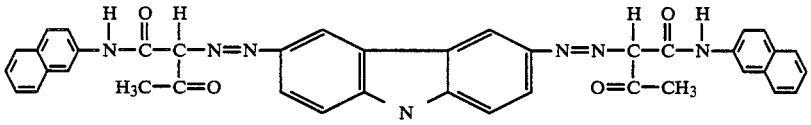

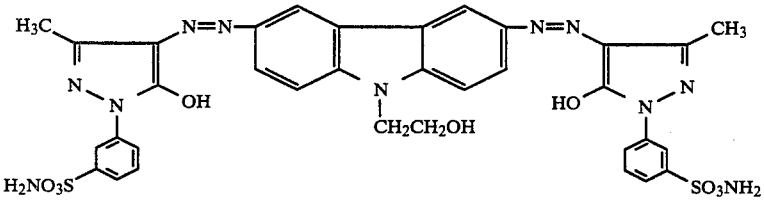

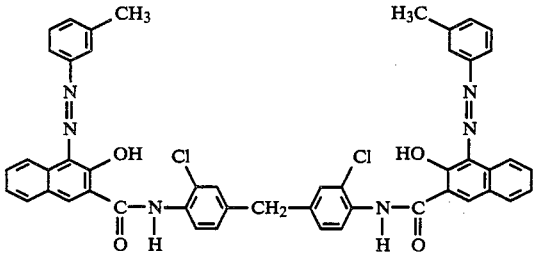

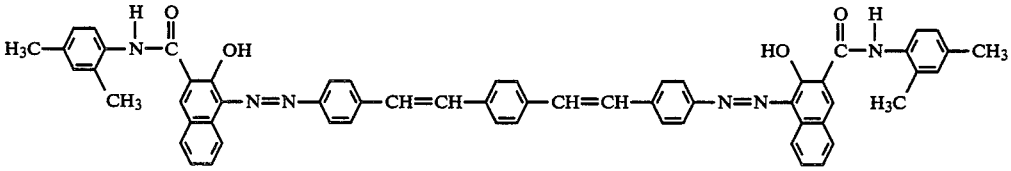

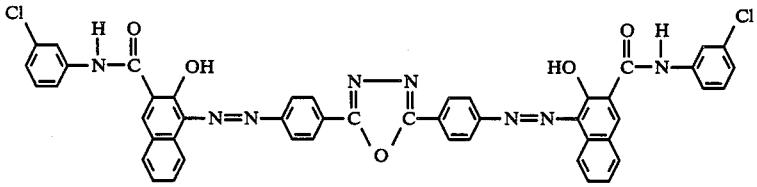

-continued

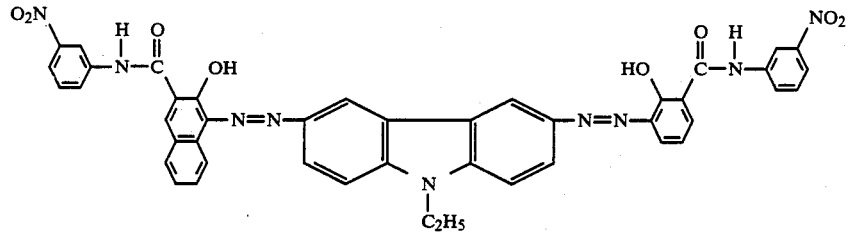

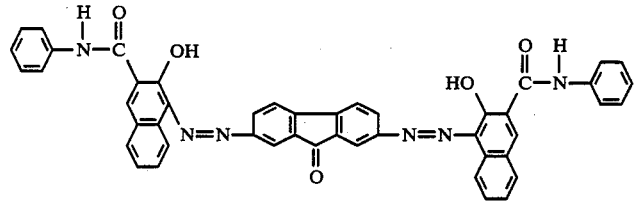

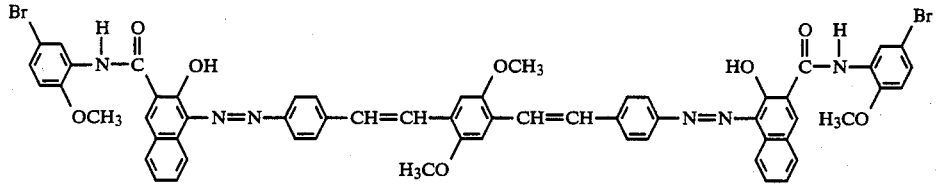

As the charge transport material which is a major component included in the charge transport layer, there can be used high molecular weight compounds such as poly-N-vinylcarbazole, halogenated poly-N-vinylcarbazole, polyvinylpyrene, polyvinylindoloquinoxaline, polyvinylbenzothiophene, polyvinylanthracene, polyvinylacridine, polyvinylpyrazoline, etc., low molecular weight compounds such as fluorene, fluorenone, 2,7-dinitro-9-fluorenone, 2,4,7-trinitro-9-fluorenone, 4H-indeno-(1,2,6)thiophene-4-one, 3,7-dinitro-dibenzothiophene-5-oxide, 1-bromopyrene, 2-phenylpyrene, carbazole, 3-phenylcarbazole, 2-phenylindole, 2-phenylnaphthalene, oxadiazole, triazole, 1-phenyl-3-(p-diethylaminostyryl)-5-(p-diethylaminophenyl)pyrazoline, 2-phenyl-4-(p-diethylaminophenyl)-5-phenyloxazole, triphenylamine, imidazole, chrysene, tetraphene, acridine, and their derivatives.

In order to further improve the dark decay and light fatigue, the charge generating layer may further contain a cyanine dye base of the formula:

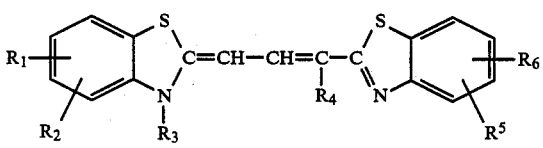

(I)

wherein $R_1$, $R_2$, $R_3$, $R_4$, $R_5$ and $R_6$ are independently a hydrogen atom, a halogen atom, an alkyl group preferably having 1 to 4 carbon atoms, an aralkyl group preferably having 1 to 4 carbon atoms at the portion except for the aryl group such as a phenyl group, an acyl group, a hydroxyl group, a phenyl group or a substituted phenyl group, and/or a styryl dye base of the formula:

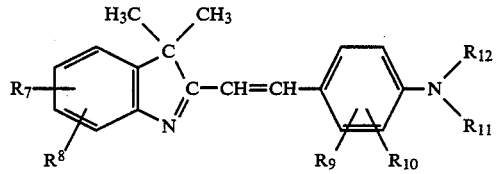

(II)

wherein $R_7$, $R_8$, $R_9$ and $R_{10}$ are independently a hydrogen atom, a halogen atom, an alkyl group preferably having 1 to 4 carbon atoms, an aralkyl group preferably having 1 to 4 carbon atoms at the portion except for the aryl group such as a phenyl group, an acyl group, a hydroxyl group, a phenyl group or a substituted phenyl group; and $R_{11}$ and $R_{12}$ are independently a hydrogen atom or an alkyl group preferably having 1 to 4 carbon atoms.

Examples of the cyanine dye base of the formula (1) are

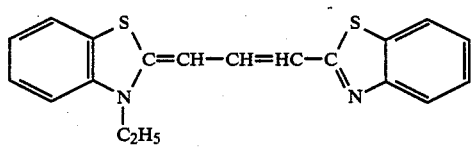

and the like.

Examples of the styryl dye base of the formula (II) are:

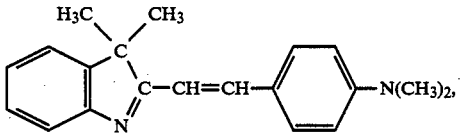

-continued

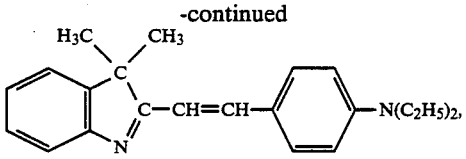

and the like.

The cyanine dye base of the formula (I) and/or the styryl dye base of the formula (II) are used in an amount of 40% by weight or less, if no silane coupling agent is added. When the cyanine dye base of the formula (I) and/or the styryl dye base of the formula (II) are used together with the silane coupling agent in the charge generating layer, these dye bases and the silane coupling agent are used in an amount of 40% by weight or less as a total. If the total amount is more than 40% by weight, the sensitivity of the electrophotographic plate is lowered. The charge generating layer may contain one or more conventional binders, plasticizers, additives other than the above-mentioned organic pigment and if necessary, the silane coupling agent, the cyanine dye base and/or the styryl dye base. The binder is used in an amount of 300% by weight or less based on the weight of the organic pigment. If the amount is more than 300% by weight, electrophotographic properties are lowered. The plasticizer is preferably used in an amount of 5% by weight or less based on the weight of the organic pigment. Other additives may be used in an amount of 3% by weight or less based on the organic pigment.

The charge transport layer may contain other than the above-mentioned charge transport material the above-mentioned cyanine dye base of the formula (I) and/or styryl dye base of the formula (II) in order to improve the dark decay and light fatigue. The cyanine dye base of the formula (I) and/or the styryl dye base of the formuola (II) are used in an amount of 30% by weight or less, if no silane coupling agent is added. When the cyanine dye base and/or the styryl dye base are used together with the silane coupling agent in the charge transport layer, these dye bases and the silane coupling agent are used in an amount of 30% by weight or less as a total. If the total amount is more than 30% by weight, electrophotographic properties are lowered. The charge transport layer may contain one or more conventional binders, plasticizers, additives other than the charge transport material, and if necessary, the silane coupling agent, the cyanine dye base and/or the styryl dye base. When the high molecular compound is used as the charge transport material, the use of binder is not necessary, but the binder may be used in an amount of 300% by weight or less based on the weight of the high molecular compound. If the amount is more than 300% by weight, electrophotographic properties are lowered. When the low molecular weight compound is used as the charge transport material, the binder is used in an amount of 30 to 300% by weight based on the weight of the low molecular weight compound. If the amount is less than 30% by weight, the formation of the charge transport layer becomes difficult, while if the amount is more than 300% by weight, electrophotographic properties are lowered. The plasticizer and other additves may optionally be used in an amount of 5% by weight or less based on the weight of the charge transport material.

As the electroconductive layer, there can be used paper or plastic film treated for electroconductivity, metal (e.g. aluminum) foil-clad plastic film, and the like. The electroconductive material can take any shapes such as sheet, plate, etc. When a metal is used, a drum-like shape may be employed.

An electrophotographic plate produced by forming a charge generating layer on an electroconductive layer and forming a charge transport layer on the charge generating layer in this invention is preferable from the viewpoint of electrophotographic properties, but the charge generating layer may be formed on the charge transport layer which has been formed on the electroconductive layer. The thickness of the charge generating layer is preferably 0.01 to 10 μm, more preferably 0.2 to 5 μm. If the thickness is less than 0.01 μm, there is a tendency to make the formation of uniform charge generating layer difficult, while if the thickness is more than 10 μm, there is a tendency to lower electrophotographic properties. The thickness of the charge transport layer is preferably 5 to 50 μm, more preferably 8 to 20 μm. If the thickness is less than 5 μm, the initial potential is lowered, while if the thickness is more than 50 μm, there is a tendency to lower the sensitivity.

The charge generating layer can be formed by a conventional process, for example, by vapor deposition of the components of the charge generating layer, or by coating a uniform solution or dispersion of the components of the charge generating layer, followed by drying. In the latter case, there can be used as solvent ketones such as acetone, methyl ethyl ketone, etc., ethers such as tetrahydrofuran, dioxane, etc., aromatic solvents such as toluene, xylenes, etc.

The charge transport layer can be formed by a conventional process, for example, by coating a solution or dispersion obtained by dissolving the components of the charge transport layer in a solvent such as those mentioned above, followed by drying.

In any cases wherein the charge generating layer and the charge transport layer are formed on the electroconductive layer in this order or in reverse order, it is necessary to make the silane coupling agent present at least in the charge generating layer or in the charge transport layer or at the interface of these layers.

The silane coupling agent can be included in at least in the charge generating layer or in the charge transport layer by employing the methods mentioned above. When the silane coupling agent is made present at the interface of the charge generating layer and the charge transport layer, there may be used the following methods. First, the charge generating layer (or the charge transport layer) is formed on the electroconductive layer, then on the surface of the charge generating layer (or the charge transport layer) formed, (1) a liquid silane coupling agent is coated, or (2) a solution obtained by diluting the silane coupling agent with an organic solvent such as acetone, methyl ethyl ketone, ethyl ether, tetrahydrofuran, dioxane, chloroform, dichloromethane, carbon tetrachloride, ethyl acetate, benzene, toluene, xylenes, n-hexane, methanol, ethanol, isopropyl alcohol, n-butanol, or the like is coated, followed by drying. After such a treatment, the charge tansport layer (or the charge generating layer) is formed thereon.

When the silane coupling agent is made present at the interface of the charge generating layer and the charge transport layer by a method as mentioned above, there may be used other than the silane coupling agent one or more conventional binders, plasticizers, additives such as flowability imparting agents, pin hole controller, etc. But these agents or additives should be used in an amount of 30% by weight or less as a whole based on the weight of the silane coupling agent. If the total amount is more than 30% by weight, the sensitivity is lowered and the residual potential is easily increased.

The electrophotographic plate of this invention may further contain a thin binding layer or barrier layer just over the electroconductive layer, or a protective layer such as a silicon layer on the surface of the electrophotographic plate.

The copying method using the electrophotographic plate of this invention can be conducted in the same manner as in a conventional process, i.e., after conducting the charge and exposure on the surface, development is conducted and images are transferred to a usual paper and fixed.

The electrophotographic plate of this invention has advantages in that the sensitivity is high, the dark decay is small and the light fatigue is little, and the like.

This invention is illustrated by way of the following Examples and Comparative Examples.

In the following Examples, the following materials are used. In the parentheses, abbreviations of individual materials are indicated.

| | |
|---|---|
| (1) Organic Pigments for Charge Generation | |
| Disazo series: | Symular East Blue 4135 (SFB) (a trade name, mfd. by Dainippon Ink and Chemicals, Inc., Japan) |
| Phthalocyanine series: | Fastogen Blue FGF (FGF) (a trade name, mfd. by Dainippon Ink and Chemicals, Inc., Japan) |
| Monoazo series: | Resino Red BX (BX) (a trade name, mfd. by Konishiroku Photo Industry Co., Ltd., Japan) |
| (2) Charge Transport Material | |
| 2-(p-Diethylamino)phenyl-4-(p-dimethylamino)-phenyl-6-(o-chloro)phenyl-1,3-oxazole (OXZ) | |
| 1-Phenyl-3-(p-diethylaminostyryl)-5-(p-diethylaminophenyl)-pyrazoline (PYZ) | |
| (3) Silane Coupling Agent | |
| Aminosilane: | N—β-(Aminoethyl)-γ-aminopropyltrimethoxysilane (KBM 603, a trade name, mfd. by Shin-etsu Chemical Industry Co., Ltd.) |
| Mercaptosilane: | γ-Mercaptopropyltrimethoxysilane (KBM 803, a trade name, mfd. by Shin-etsu Chemical Industry Co., Ltd.) |
| (4) Binder | |
| Polystyrene: | Hammer ST (a trade name, mfd. by Mitsui Toatsu Chemical's Inc., Japan) |
| Silicone Varnish: | KR-255 (non-volatile content 50%) (a trade name, mfd. by Shin-etsu Chemical Industry Co., Ltd.) |
| Polyester: | Vylon 200 (a trade name, mfd. by Toyobo Co., Ltd., Japan) |
| (5) Dye Base | |
| Cyanine Dye Base: | 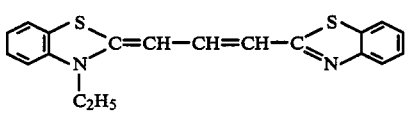 (NK-2321, a trade name, mfd. by Japanese Research Institute for Photosensitizing Dyes, Ltd., Japan) |
| Styryl Dye Base: | 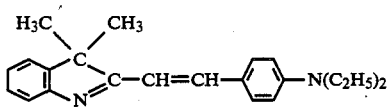 (NK-2020, a trade name, mfd. by Japanese Research Institute for photosensitizing Dyes, Ltd., Japan) |

COMPARATIVE EXAMPLES 1 TO 3

An organic pigment and a binder as shown in Table 1 were mixed in prescribed amounts. To this, methyl ethyl ketone was added so as to make the solid content 3% by weight. The resulting mixture liquid in an amount of 80 g was kneaded in a ball mill (a 3-inch pot, mfd. by Nippon Kagaku Togyo Co., Ltd., Japan) fot 8 hours. The thus obtained pigment dispersion was coated on an aluminum plate (the electroconductive layer having a size of 10 cm×8 cm×0.1 m, the same size being used hereinafter) by using an applicator and dried at 90° C. for 15 minutes to give a charge generating layer of 1 μm thick.

Then, a charge transport material and a binder as shown in Table 1 were mixed in prescribed amounts. To this, methyl ethyl ketone was added so as to make the solid content 30% by weight to dissolve the solids completely. The resulting solution was coated on the above-mentioned charge generating layer by using an applicator and dried at 90° C. for 20 minutes to form a charge transport layer of 15 μm thick.

Electrophotographic properties of the resulting electrophotographic plates were measured by using an electrostatic recording paper analyzer (SP-428 made by Kawaguchi Electric Works Co., Ltd., Japan). The results are as shown in Table 1.

In Table 1, the initial potential ($V_o$) means a charge potential obtained by conducting negative corona discharge at 5 kV for a moment, the dark decay ($V_k$) means potential decay after placing the corona discharged plate in the dark for 10 seconds, and the half decay exposure sensitivity ($E_{50}$) means the light amount necessary for decreasing the surface potential to a half after the illumination with white light of 10 lux.

Further, in order to study the effect of light fatigue, electrophotographic properties immediately after the exposure to white light of 1250 lux for 10 minutes ($V_o'$, $V_k'$ and $E_{50}'$ being measured in the same manner as described in the cases of $V_o$, $V_k$ and $E_{50}$) and the ratio of initial potentials after and before the exposure ($V_o'/V_o$), which is a measure of the light fatigue, are also listed in Table 1.

EXAMPLES 1 TO 3

To a pigment dispersion obtained by kneading an organic pigment and a binder in prescribed amounts as shown in Table 1 in the same manner as described in Comparative Examples 1 to 3, a silane coupling agent as shown in Table 1 in a prescribed amount was added and dissolved. The resulting coating liquid was coated on an aluminum plate by using an applicator and dried at 90° C. for 15 minutes to form a charge generating layer of 1 μm thick. A charge transport layer was formed by the formation as shown in Table 1 in the same manner as described in Comparative Examples 1 to 3.

Electrophotographic properties of the resulting electrophotographic plates are shown in Table 1.

EXAMPLES 4 TO 6

Using an organic pigment and a binder as shown in Table 1, a charge generating layer was formed in the same manner as described in Comparative Examples 1 to 3. Using a charge transport material, a binder and a silane coupling agent as shown in Table 1, a charge transport layer was formed in the same manner as described in Comparative Examples 1 to 3.

Electrophotographic properties of the resulting electrophotographic plates are shown in Table 1.

TABLE 1

(Effects of Silane Coupling Agent)

| Example No. | Charge generating layer: Organic pigment (wt %) | | Binder (wt %) | | Silane coupling agent (wt %) | | Charge transport layer: Charge transport material (wt %) | | Binder (wt %) | |
|---|---|---|---|---|---|---|---|---|---|---|
| Comparative Example 1 | SFB | 50 | Silicone varnish | 50 | — | — | OXZ | 50 | Polyester | 50 |
| Comparative Example 2 | SFB | 50 | " | 50 | — | — | PYZ | 30 | Silicone varnish | 70 |
| Comparative Example 3 | FGF/BX | 25/25 | Polyester | 50 | — | — | OXZ | 50 | " | 50 |
| Example 1 | SFB | 47.5 | Polystyrene | 47.5 | Aminosilane | 5 | OXZ | 50 | Polyester | 50 |
| Example 2 | SFB | 45 | Silicone varnish | 45 | " | 10 | OXZ | 50 | " | 50 |
| Example 3 | FGF/BX | 31.5/31.5 | Polyester | 27 | Mercaptosilane | 10 | OXZ | 70 | Silicone varnish | 30 |
| Example 4 | SFB | 50 | Silicone varnish | 50 | — | — | OXZ | 50 | Polyester | 49 |
| Example 5 | SFB | 70 | Polyester | 30 | — | — | PYZ | 30 | Silicone varnish | 65 |
| Example 6 | FGF/BX | 25/25 | Polyester | 50 | — | — | OXZ | 55 | " | 35 |
| Example 7 | SFB | 45 | Silicone varnish | 45 | Aminosilane | 10 | OXZ | 50 | Polyester | 48 |
| Example 8 | SFB | 50 | Silicone varnish | 40 | Mercaptosilane | 10 | PYZ | 35 | Silicone varnish | 62 |
| Example 9 | SFB | 40 | Polyester | 40 | " | 20 | OXZ | 50 | Polyester | 49.5 |

| Example No. | Charge transport layer: Silane coupling agent (wt %) | | Electrophotographic properties: $V_o$ (V) | $V_k$ (%) | $E_{50}$ (lux-sec) | Electrophotographic properties (after exposure): $V_o'$ (V) | $V_k'$ (%) | $E_{50}'$ (lux-sec) | Light fatigue $V_o'/V_o$ (%) |
|---|---|---|---|---|---|---|---|---|---|
| Comparative Example 1 | — | — | 870 | 44 | 5 | 200 | 22 | * | 23 |
| Comparative Example 2 | — | — | 820 | 35 | 2 | 150 | 18 | * | 18 |
| Comparative Example 3 | — | — | 860 | 43 | 11 | 190 | 27 | * | 22 |
| Example 1 | — | — | 900 | 73 | 5 | 620 | 65 | 5 | 69 |
| Example 2 | — | — | 910 | 87 | 5 | 710 | 78 | 5 | 78 |
| Example 3 | — | — | 880 | 83 | 11 | 640 | 76 | 11 | 73 |
| Example 4 | Aminosilane | 1 | 890 | 71 | 5 | 630 | 63 | 5 | 71 |
| Example 5 | " | 5 | 840 | 66 | 3 | 590 | 59 | 3 | 70 |
| Example 6 | Mercaptosilane | 10 | 880 | 79 | 11 | 670 | 68 | 11 | 78 |
| Example 7 | Aminosilane | 2 | 920 | 97 | 6 | 850 | 88 | 5 | 92 |
| Example 8 | " | 3 | 850 | 81 | 5 | 660 | 72 | 5 | 78 |
| Example 9 | Mercaptosilane | 0.5 | 930 | 93 | 5 | 810 | 84 | 5 | 87 |

(Note)
*Impossible to measure

EXAMPLES 7 TO 9

To a pigment dispersion obtained by kneading an organic pigment and a binder in prescribed amounts as shown in Table 1 in the same manner as described in Comparative Examples 1 to 3, a silane coupling agent as shown in Table 1 in a prescribed amount was added and dissolved. The resulting coating liquid was coated on an aluminum plate by using an applicator and dried at 90° C. for 15 minutes to form a charge generating layer of 1 μm thick. Using a charge transport material, a binder and a silane coupling agent as shown in Table 1, a charge transport layer was formed in the same manner as described in Comparative Examples 1 to 3.

Electrophotographic properties of the resulting electrophotographic plates are shown in Table 1.

COMPARATIVE EXAMPLES 4 TO 6

Electrophotographic plates were produced in the same manner as described in Comparative Examples 1 to 3 except for thickening the thickness of each charge generating layer as shown in Table 2 using the materials as listed in Table 2.

Electrophotographic properties of the resulting electrophotographic plates are shown in Table 2.

EXAMPLES 10 TO 12

Electrophotographic plates were produced in the same manner as described in Examples 1 to 3 and 7 to 9 except for thickening the thickness of each charge generating layer as shown in Table 2 using the materials as listed in Table 2.

Electrophotographic properties of the resulting electrophotographic plates are shown in Table 2.

TABLE 2

| Example No. | Charge generating layer: Organic pigment (wt %) | | Binder (wt %) | | Silane coupling agent (wt %) | | Thickness (μm) | Charge transport layer (thickness 15 μm): Charge transport material (wt %) | | Binder (wt %) | |
|---|---|---|---|---|---|---|---|---|---|---|---|
| Comparative Example 4 | SFB | 50 | Silicone varnish | 50 | — | — | 1 | OXZ | 50 | Polystyrene | 50 |
| Comparative Example 5 | SFB | 50 | " | 50 | — | — | 3 | OXZ | 50 | " | 50 |
| Comparative Example 6 | SFB | 50 | " | 50 | — | — | 5 | OXZ | 50 | " | 50 |
| Example 10 | SFB | 45 | " | 45 | Aminosilane | 10 | 3 | OXZ | 50 | " | 50 |
| Example 11 | SFB | 45 | " | 45 | " | 10 | 5 | OXZ | 50 | " | 49 |

TABLE 2-continued

| | | | | | | | | | | | | |
|---|---|---|---|---|---|---|---|---|---|---|---|---|
| Example 12 | SFB | 45 | " | 45 | " | 10 | 5 | OXZ | 50 | Polyester | 48 | |

| Example No. | Charge transport layer (thickness 15 μm) Silane coupling agent (wt %) | | Electrophotographic properties $V_o$ (V) | $V_k$ (%) | $E_{50}$ (lux-sec) | Electrophotographic properties (after exposure) $V_o'$ (V) | $V_k'$ (%) | $E_{50}'$ (lux-sec) | Light fatigue $V_o'/V_o$ (%) |
|---|---|---|---|---|---|---|---|---|---|
| Comparative Example 4 | — | — | 860 | 66 | 5 | 550 | 54 | 5 | 64 |
| Comparative Example 5 | — | — | 920 | 59 | 6 | 320 | 51 | — | 35 |
| Comparative Example 6 | — | — | 1010 | 54 | 8 | 220 | 48 | — | 22 |
| Example 10 | — | — | 920 | 84 | 5 | 790 | 78 | 5 | 86 |
| Example 11 | Mercaptosilane | 1 | 1020 | 81 | 6 | 850 | 73 | 6 | 83 |
| Example 12 | Aminosilane | 2 | 1060 | 83 | 6 | 860 | 72 | 6 | 81 |

EXAMPLE 13

In a ball mill (a 3-inch pot, mfd. by Nippon Kagaku Togyo Co., Ltd., Japan), 1.08 g of SFB, 0.24 g of aminosilane (KBM 603) and 20 g of tetrahydrofuran were placed and kneaded for 1 hour. Subsequently, 1.2 g of silicone varnish (KR-255) and 28 g of tetrahydrofuran were added to the ball mill and kneaded for 3 hours. Then, 0.96 g of KR-255 and 29 g of tetrahydrofuran were added to the ball mill and kneaded for 4 hours. The resulting pigment dispersion was coated on an aluminum plate using an applicator and dried at 90° C. for 15 minutes to form a charge generating layer of 1 μm thick.

A charge transport layer was formed by using a charge transport material and a binder in prescribed amounts as listed in Table 3 in the same manner as described in Comparative Examples 1 to 3.

Electrophotographic properties of the resulting electrophotographic plates are shown in Table 3.

TABLE 3

| Example No. | Charge generating layer: Organic pigment (wt %) | | Binder (wt %) | | Silane coupling agent (wt %) | | Charge transport layer: Charge transport material (wt %) | | Binder (wt %) | | Silane coupling agent (wt %) | |
|---|---|---|---|---|---|---|---|---|---|---|---|---|
| Example 13 | SFB | 45 | Silicone varnish | 45 | Aminosilane | 10 | OXZ | 50 | Polyester | 50 | — | — |
| Example 14 | SFB | 40 | Polyester | 40 | Mercaptosilane | 20 | OXZ | 50 | " | 49.5 | Mercaptosilane | 0.5 |

| Example No. | Electrophotographic properties $V_o$ (V) | $V_k$ (%) | $E_{50}$ (lux-sec) | Electrophotographic properties (after exposure) $V_o'$ (V) | $V_k'$ (%) | $E_{50}$ (lux-sec) | Light fatigue $V_o'/V_o$ (%) |
|---|---|---|---|---|---|---|---|
| Example 13 | 930 | 90 | 5 | 750 | 80 | 5 | 81 |
| Example 14 | 940 | 94 | 5 | 850 | 86 | 5 | 90 |

EXAMPLE 14

In a ball mill (a 3-inch pot, mfd. by Nippon Kagaku Togyo Co., Ltd., Japan), 0.96 g of SFB, 0.48 g of mercaptosilane (KBM 803), 0.36 g of polyester (Vylon 200), and 20 g of methyl ethyl ketone were placed and kneaded for 2 hours. Then, 0.3 g of polyester (Vylon 200) and 35 g of methyl ethyl ketone were added to the ball mill and kneaded for 4 hours. Subsequently, 0.3 g of polyester (Vylon 200) and 22 g of methyl ethyl ketone were added to the ball mill and kneaded for 3 hours. The resulting pigment dispersion was coated on an aluminum plate using an applicator and dried at 90° C. for 15 minutes to form a charge generating layer of 1 μm thick.

A charge transport layer was formed by using a charge transport material and a binder in prescribed amounts as listed in Table 3 in the same manner as described in Comparative Examples 1 to 3.

Electrophotographic properties of the resulting electrophotographic plates are shown in Table 3.

EXAMPLES 15 TO 22

To a pigment dispersion obtained by kneading an organic pigment and a binder in prescribed amounts as listed in Table 4 in the same manner as described in Comparative Examples 1 to 3, a silane coupling agent, and if required a cyanine dye base and/or a styryl dye base in prescribed amounts as listed in Table 4 (Examples 15, 16 and 19 to 22) were added and dissolved. The resulting coating liquid was coated on an aluminum plate using an applicator and dried at 90° C. for 15 minutes to form a charge generating layer of 1 μm thick.

In the next place, a charge transport material, a binder and a silane coupling agent, and if required a cyanine dye base and/or a styryl dye base in prescribed amounts, as listed in Table 4 (Examples 17 to 22) were mixed and a charge transport layer of 15 μm thick was formed in the same manner as described in Comparative Examples 1 to 3.

Electrophotographic properties of the resulting electrophotographic plates are shown in Table 4.

TABLE 4

| Charge generating layer (wt %): Organic pigment | Binder Silicone | Silane coupling agent [Amino- | Cyanine dye base | Styrl dye base | Charge transport layer (wt %): Charge transport material | Binder Poly- | Silane coupling agent [Amino- |
|---|---|---|---|---|---|---|---|

TABLE 4-continued

| Example No. | SFB | varnish | silane, KBM603] | (NK-2321) | (NK-2020) | OXZ | ester | silane, KBM603] |
|---|---|---|---|---|---|---|---|---|
| Example 15 | 45 | 45 | 7 | 3 | — | 50 | 49 | 1 |
| Example 16 | 45 | 43 | 7 | — | 5 | 50 | 49 | 1 |
| Example 17 | 45 | 45 | 10 | — | — | 50 | 48 | 1 |
| Example 18 | 45 | 45 | 10 | — | — | 50 | 49 | 0.7 |
| Example 19 | 43 | 42 | 8 | 7 | — | 50 | 49 | 0.5 |
| Example 20 | 45 | 47 | 5 | — | 3 | 49 | 48 | 1.8 |
| Example 21 | 45 | 45 | 6 | 4 | — | 49 | 49 | 1.2 |
| Example 22 | 45 | 45 | 6 | 2 | 2 | 50 | 48 | 0.8 |

| | Charge transport layer (wt %) | | Electrophotographic properties | | | Electrophotographic properties (after exposure) | | | Light fatigue |
|---|---|---|---|---|---|---|---|---|---|
| Example No. | Cyanine dye base (NK-2321) | Styrl dye base (NK-2020) | $V_o$ (V) | $V_k$ (%) | $E_{50}$ (lux-sec) | $V_o'$ (V) | $V_k'$ (%) | $E_{50}'$ (lux-sec) | $V_o'/V_o$ (%) |
| Example 15 | — | — | 900 | 94 | 6 | 810 | 84 | 6 | 90 |
| Example 16 | — | — | 910 | 95 | 6 | 830 | 87 | 6 | 91 |
| Example 17 | 1 | — | 920 | 94 | 6 | 850 | 86 | 6 | 92 |
| Example 18 | — | 0.3 | 880 | 92 | 6 | 770 | 81 | 6 | 87 |
| Example 19 | 0.5 | — | 920 | 93 | 6 | 830 | 82 | 6 | 90 |
| Example 20 | — | 1.2 | 900 | 92 | 6 | 820 | 82 | 6 | 91 |
| Example 21 | — | 0.8 | 920 | 95 | 6 | 860 | 86 | 6 | 93 |
| Example 22 | 0.6 | 0.6 | 930 | 94 | 6 | 860 | 87 | 6 | 93 |

As is clear from Table 1, in Comparative Examples 1 to 3, the dark decay ($V_k$) is as low as about 40%, the light fatigue is great, and the values of ($V_o'$) are lowered to about 20% of ($V_o$).

In contrast, when the silane coupling agent is added to at least one of the charge generating layer and the charge transport layer as shown in Examples 1 to 9, both the dark decay and the light fatigue are greatly improved. Particularly, as shown in Examples 7 to 9, when the silane coupling agent is added to both of the charge generating layer and the charge transport layer, the dark decay before and after the exposure to white light of 1250 lux is improved by about 50 to 60% and the light fatigue is also improved by about 60 to 70%. In addition, when the silane coupling agent is added, lowering in the half decay exposure sensitivity is hardly observed.

Further, the degree of light fatigue is also influenced by the kind of the binder in the charge transport layer and the thickness of the charge generating layer. As shown in Comparative Example 4 in Table 2, when polystyrene is used as the binder in the charge transport layer, lowering of ($V_o'$) due to the light fatigue is relatively small in the case of the thickness of the charge generating layer being 1 μm compared with Comparative Example 1 wherein polyester is used as the binder in the charge transport layer. But, with an increase of the thickness of the charge generating layer, the lowering of ($V_o'$) due to the light fatigue becomes remarkably worse even if polystyrene is used as the binder in the charge transport layer (Comparative Examples 5 and 6). In contrast, when the silane coupling agent is added according to this invention, the lowering of ($V_o'$) due to the light fatigue is remarkably small and the dark decay becomes good, even if the thickness of the charge generating layer becomes thicker (Examples 10 to 12).

The pigment dispersion which is a coating liquid for forming the charge generating layer can be produced by either mixing whole amounts of an organic pigment, a binder, a solvent, and if required, a silane coupling agent at one time, followed by kneading as shown in Examples 1 to 12, or dispersing the pigment and the like in several times one after another as shown in Examples 13 and 14. Considering the dispersion of pigment, the latter process is preferable. Further, electrophotographic properties of the resulting electrophotographic plates obtained in Examples 13 and 14 in Table 3 are by far excellent compared with those obtained in Examples 2 and 9.

On the other hand, as shown in Table 4, when the cyanine dye base and/or styryl dye base are used together with the silane coupling agent in the charge generating layer and/or the charge transport layer, there are obtained excellent values in electrophotographic properties and the light fatigue.

COMPARATIVE EXAMPLES 7 TO 10

Electrophotographic plates were produced by using materials in prescribed amounts as listed in Table 5 in the same manner as described in Comparative Examples 1 to 3.

Electrophotographic properties of the resulting electrophotographic plates are shown in Table 5.

EXAMPLES 23 TO 31

A pigment dispersion obtained by kneading an organic pigment and a binder in prescribed amounts as shown in Table 5 in the same manner as described in Comparative Examples 1 to 3 was coated on an aluminum plate by using an applicator and dried at 90° C. for 15 minutes to form a charge generating layer of 1 μm thick.

Then, a silane coupling agent and a binder were mixed in prescribed amounts as shown in Table 5 and isopropyl alcohol was added thereto so as to make the solid content 1% by weight. The resulting solution was coated on the surface of the charge generating layer by using an applicator and dried at 90° C. for 15 minutes (the amount of silane coupling agent coated being shown in Table 5).

A charge transport layer was formed on the charge generating layer coated with the silane coupling agent by using the formulation as shown in Table 5 in the same manner as described in Comparative Examples 1 to 3.

Electrophotographic properties of the resulting electrophotographic plates are shown in Table 5.

As is clear from Table 5, in Comparative Examples 7 to 10, the initial potential after exposure ($V_o'$) to white light of 1250 lux for 10 minutes are all remarkably lowered compared with ($V_o$) and the phenomenon of light fatigue is also observed. Further, the dark decay ($V_k$) is as poor as about 30 to 50%.

In contrast, when the surface of the charge generating layer is treated with the silane coupling agent as in Examples 23 to 31, the light fatigue is greatly lessened and the values ($V_o'/V_o$) are improved to 70% or more in all the cases. Further, the dark decay ($V_k$) is improved to 80% or more and the initial potential ($V_o$) is increased by 100 V or more. The half decay exposure ($E_k$) sensitivity is not lowered greatly, although there is a tendency to be lowered slightly.

Then, the resulting surface was exposed to ultraviolet light by using a high-pressure mercury lamp (an ultraviolet irradiation apparatus mfd. by Toshiba Denzai K.K., using one high-pressure mercury lamp H 5600L/2, 5.6 kW) at a distance of 10 cm for 30 seconds to form a protective layer thereon.

Electrophotographic properties of the resulting electrophotographic plates are shown in Table 6.

In Table 6, the residual potential $V_R$ means a residual potential obtained by charging an electrophotographic plate by conducting negative corona discharge at 5 kV at a moment, and then illuminating it with white light of 10 lux for 10 seconds and standing for 25 seconds, and the residual potential $V_R'$ means a residual potential obtained in the same manner as mentioned above immediately after the illumination with white light of 1250 lux for 10 minutes, the unit being V (volt).

$V_R$ and $V_R'$ of the electrophotographic plates obtained in Examples 1 to 31 were also measured in the same manner as mentioned above with the results that all the values were zero volt.

TABLE 5

| Example No. | Charge generating layer: Organic pigment wt % | | Binder wt % | | Treating liquid: Silane coupling agent wt % | | Binder wt % | | Coating amount of silane coupling agent (mg/cm²) |
|---|---|---|---|---|---|---|---|---|---|
| Comparative Example 7 | SFB | 60 | Silicone varnish | 40 | — | — | — | — | — |
| Comparative Example 8 | " | 50 | " | 50 | — | — | — | — | — |
| Comparative Example 9 | " | 50 | " | 50 | — | — | — | — | — |
| Comparative Example 10 | FGF | 60 | " | 40 | — | — | — | — | — |
| Example 23 | SFB | 60 | " | 40 | Aminosilane | 100 | — | — | 0.20 |
| Example 24 | " | 60 | " | 40 | Mercaptosilane | 100 | — | — | 0.70 |
| Example 25 | " | 60 | " | 40 | Aminosilane | 80 | Silicone varnish | 20 | 0.20 |
| Example 26 | " | 50 | " | 50 | " | 100 | — | — | 1.20 |
| Example 27 | " | 50 | " | 50 | " | 75 | Silicone varnish | 25 | 0.40 |
| Example 28 | " | 50 | " | 50 | " | 100 | — | — | 5.00 |
| Example 29 | " | 50 | " | 50 | Mercaptosilane | 90 | Silicone varnish | 10 | 0.10 |
| Example 30 | FGF | 60 | " | 40 | Aminosilane | 100 | — | — | 0.05 |
| Example 31 | " | 60 | " | 40 | Mercaptosilane | 100 | — | — | 0.01 |

| Example No. | Charge transport layer: Charge transport material wt % | | Binder wt % | | Electrophotographic properties: $V_o$ (V) | $V_k$ (%) | $E_{50}$ (lux-sec) | Electrophotographic properties (after exposure): $V_o'$ (V) | $V_k'$ (%) | $E_{50}'$ (lux-sec) | Light fatigue $V_o'/V_o$ (%) |
|---|---|---|---|---|---|---|---|---|---|---|---|
| Comparative Example 7 | OXZ | 50 | Silicone varnish | 50 | 850 | 51 | 5 | 250 | 27 | * | 29 |
| Comparative Example 8 | OXZ | 50 | Polyester | 50 | 870 | 44 | 5 | 200 | 22 | * | 23 |
| Comparative Example 9 | PYZ | 40 | Silicone varnish | 60 | 820 | 33 | 2 | 160 | 21 | * | 19 |
| Comparative Example 10 | OXZ | 60 | " | 40 | 860 | 49 | 7 | 230 | 30 | * | 27 |
| Example 23 | OXZ | 50 | " | 50 | 980 | 83 | 5 | 860 | 76 | 5 | 88 |
| Example 24 | OXZ | 50 | " | 50 | 1060 | 88 | 5 | 950 | 79 | 5 | 90 |
| Example 25 | OXZ | 50 | " | 50 | 1090 | 89 | 5 | 970 | 78 | 5 | 89 |
| Example 26 | OXZ | 50 | Polyester | 50 | 1120 | 86 | 5 | 800 | 75 | 5 | 71 |
| Example 27 | OXZ | 50 | " | 50 | 1220 | 88 | 6 | 960 | 76 | 6 | 79 |
| Example 28 | PYZ | 40 | Silicone varnish | 60 | 1060 | 82 | 4 | 820 | 72 | 4 | 77 |
| Example 29 | PYZ | 40 | " | 60 | 1020 | 83 | 3 | 780 | 71 | 3 | 76 |
| Example 30 | OXZ | 60 | Polyester | 40 | 980 | 87 | 7 | 810 | 74 | 7 | 83 |
| Example 31 | OXZ | 60 | Silicone varnish | 40 | 960 | 86 | 7 | 810 | 75 | 7 | 84 |

(Note)
*impossible to measure

COMPARATIVE EXAMPLES 11 TO 13

The surface of electrophotographic plate obtained in Comparative Example 8 was treated with a silane coupling agent as shown in Table 6 in the same manner as described in Example 23. Subsequently, a 5% by weight solution of tris(2-acyloyloxyethyl)isocyanurate (the solvent being a mixture of toluene and isorpopanol (1:1 by weight)) was coated thereon by using an applicator having a gap of 50 μm and dried at 90° C. for 2 minutes.

TABLE 6

| Example No. | Charge generating layer: Organic pigment (wt %) | | Binder (wt %) | | Charge transport layer: Charge transport material (wt %) | | Binder (wt %) | | Coating amount of silane coupling agent (mg/cm²) |
|---|---|---|---|---|---|---|---|---|---|
| Comparative Example 11 | SFB | 50 | Silicone varnish | 50 | OXZ | 50 | Polystyrene | 50 | 1.20 |

TABLE 6-continued

| | | | | | | | | | |
|---|---|---|---|---|---|---|---|---|---|
| Comparative Example 12 | SFB | 50 | " | 50 | OXZ | 50 | " | 50 | 0.40 |
| Comparative Example 13 | SFB | 50 | " | 50 | OXZ | 50 | " | 50 | 0.05 |

| | Electrophotographic properties | | | | Electrophotographic properties (after exposure) | | | | Light fatigue |
|---|---|---|---|---|---|---|---|---|---|
| Example No. | $V_o$ (V) | $V_k$ (%) | $E_{50}$ (lux-sec) | $V_R$ (V) | $V_o'$ (V) | $V_k'$ (%) | $E_{50}'$ (lux-sec) | $V_R'$ (V) | $V_o'/V_o$ (%) |
| Comparative Example 11 | 1020 | 46 | 7 | 100 | 260 | 32 | 7 | 75 | 25 |
| Comparative Example 12 | 940 | 47 | 6 | 60 | 220 | 27 | 6 | 40 | 23 |
| Comparative Example 13 | 930 | 47 | 5 | 40 | 250 | 28 | 5 | 30 | 27 |

As mentioned above, the electrophotographic plates obtained in Examples 1 to 31 show excellent properties in the initial potential after the exposure, the dark decay before and after the exposure and the residual potential after and before the exposure.

As is clear from the above descriptions, the electrophotographic plate of this invention is characterized in that (1) the dark decay is small, (2) lowering in charge potential is small and the dark decay is not increased even if repeating charge/exposure (that is, light fatigue is little), and (3) high sensitivity is shown.

What is claimed is:

1. In an electrophotographic plate comprising an electroconductive layer, a charge generating layer containing one or more organic pigments for charge generation and a charge transport layer containing charge transport material having functions of charge maintenance and charge transport, the improvement wherein a silane coupling agent is present in the charge generating layer in an amount of 0.5 to 40% by weight based on the weight of the charge generating layer.

2. An electrophotographic plate according to claim 1, wherein a silane coupling agent is also present in the charge transport layer in an amount of 0.05 to 30% by weight based on the weight of the charge transport layer.

3. An electrophotographic plate according to claim 1, wherein a silane coupling agent is also present at the interface of the charge generating layer and the charge transport layer in an amount of $10^{-4}$ mg/cm$^2$ to $10^2$ mg/cm$^2$.

4. An electrophotographic plate according to claim 1, wherein the silane coupling agent is an aminosilane.

5. An electrophotographic plate according to claim 1, wherein the silane coupling agent is a mercaptosilane.

6. An electrophotographic plate according to claim 4, wherein the aminosilane is N-$\beta$-(aminoethyl)-$\gamma$-aminopropyltrimethoxysilane.

7. An electrophotographic plate according to claim 5, wherein the mercaptosilane is $\gamma$-mercaptopropyltrimethoxysilane.

8. An electrophotographic plate according to claim 1, wherein the charge generating layer and/or the charge transport layer contains a cyanine dye base of the formula:

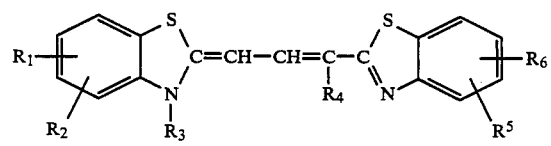

(I)

wherein $R_1$, $R_2$, $R_3$, $R_4$, $R_5$ and $R_6$ are independently a hydrogen atom, a halogen atom, an alkyl group, an aralkyl group, an acyl group, a hydroxyl group, a phenyl group or a substituted phenyl group, and/or a styryl dye base of the formula:

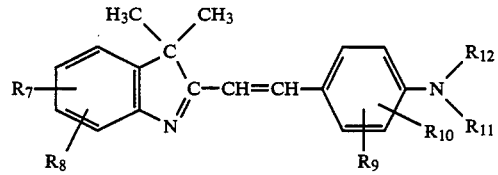

(II)

wherein $R_7$, $R_8$, $R_9$, and $R_{10}$ are independently a hydrogen atom, a halogen atom, an alkyl group, an aralkyl group, an acyl group, a hydroxyl group, a phenyl group, or a substituted phenyl group; and $R_{11}$ and $R_{12}$ are independently a hydrogen atom or an alkyl group.

9. An electrophotographic plate according to claim 8, wherein the charge generating layer contains the silane coupling agent and the cyanine dye base of the formula (I) and/or the styryl dye base of the formula (II) in a total amount of 40% by weight or less.

10. An electrophotographic plate according to claim 8, wherein the charge transport layer contains a silane coupling agent in an amount of 0.05% by weight, and the silane coupling agent and the cyanine dye base of the formula (I) and/or the styryl dye base of the formula (II) in a total amount of 30% by weight or less.

11. An electrophotographic plate comprising an electroconductive layer, a charge generating layer consisting essentially of organic material including at least one organic pigment for charge generation and a polymeric binder and a charge transport layer having functions of charge maintenance and charge transport and consisting essentially of organic material including high or low molecular weight charge transporting compounds and a polymeric binder; a silane coupling agent being present in the charge generating layer in an amount of 0.5 to 40% by weight based on the weight of the charge generating layer.

12. An electrophotographic plate according to claim 11, wherein the silane coupling agent is selected from the group consisting of an amino silane and a mercapto silane.

13. An electrophotographic plate according to claim 12, wherein the charge generating layer and/or the charge transport layer contains a cyanine dye base of the formula:

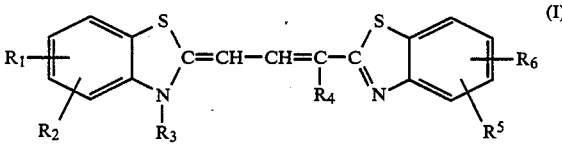

(I)

wherein $R_1$, $R_2$, $R_3$, $R_4$, $R_5$ and $R_6$ are independently a hydrogen atom, a halogen atom, an alkyl group, an aralkyl group, an acyl group, a hydroxyl group, a phenyl group or a substituted phenyl group, and/or a styryl dye base of the formula:

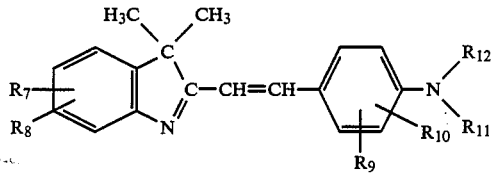

(II)

wherein $R_7$, $R_8$, $R_9$, and $R_{10}$ are independently a hydrogen atom, a halogen atom, an alkyl group, an aralkyl group, an acyl group, a hydroxyl group, a phenyl group, or a substituted phenyl group; and $R_{11}$ and $R_{12}$ are independently a hydrogen atom or an alkyl group.

14. An electrophotographic plate according to claim 13, wherein the charge generating layer contains the silane coupling agent and the cyanine dye base of the formula (I) and/or the styryl dye base of the formula (II) in a total amount of 40% by weight or less.

15. An electrophotographic plate according to claim 13, wherein the charge transport layer contains a silane coupling agent in an amount of 0.05% by weight, and the silane coupling agent and the cyanine dye base of the formula (I) and/or the styryl dye base of the formula (II) in a total amount of 30% by weight or less.

16. An electrophotographic plate according to claim 11, wherein said charge generating layer and said charge transport layer are each formed without the addition of inorganic photoconductive substances.

17. An electrophotographic plate according to claim 11, wherein said charge generating layer has a thickness of 0.01 to 10 μm and the charge transport layer has a thickness of 5 to 50 μm.

18. An electrophotographic plate according to claim 1, wherein the charge generating layer has a thickness of 0.1 to 10 μm and the charge transport layer has a thickness of 5 to 50 μm.

* * * * *